United States Patent [19]

Kish et al.

[11] 4,171,127

[45] Oct. 16, 1979

[54] APPARATUS FOR COLLATING PAGES OF MULTI-UP PRINTED DOCUMENTS

[75] Inventors: Richard E. Kish, Fairfield; Andrew W. Rastorguyeff, Norwalk, both of Conn.

[73] Assignee: Pitney-Bowes, Inc., Stamford, Conn.

[21] Appl. No.: 866,627

[22] Filed: Jan. 3, 1978

[51] Int. Cl.[2] ..... B65H 39/04

[52] U.S. Cl. ..... 270/58; 271/234

[58] Field of Search ..... 270/58; 271/64; 209/74 R

[56] References Cited

U.S. PATENT DOCUMENTS

| | | | |
|---|---|---|---|
| 2,879,991 | 3/1959 | Pitner | 270/58 |
| 3,026,107 | 3/1962 | Stroud | 270/58 |

FOREIGN PATENT DOCUMENTS

| | | | |
|---|---|---|---|
| 1472444 | 5/1977 | United Kingdom | 270/58 |

*Primary Examiner*—Edgar S. Burr

*Assistant Examiner*—A. Heinz

*Attorney, Agent, or Firm*—Martin D. Wittstein; William D. Soltow, Jr.; Albert W. Scribner

[57] ABSTRACT

An apparatus for collating pages of a document, which are sequentially printed on a continuous sheet in multipage rows, that is in multi-up fashion, comprises a plurality of decks at least equal in number to the number of pages in each row. Each deck has a surface for receiving one document page and is positionable at a level above one deck surface adjacent thereto to define a step-like structure. A page slitter separates adjacent pages in a multipage row and a row cutter separates adjacent multipage rows. From the slitter and cutter, alongitudial delivery mechanism simultaneously delivers each of the individual pages to a single deck. A lateral transfer mechanism then transfers each page of the document from the deck to which it was delivered to the top of the page delivered to the adjacent lower deck in order to complete the collating operation.

25 Claims, 11 Drawing Figures

Fig. 9.
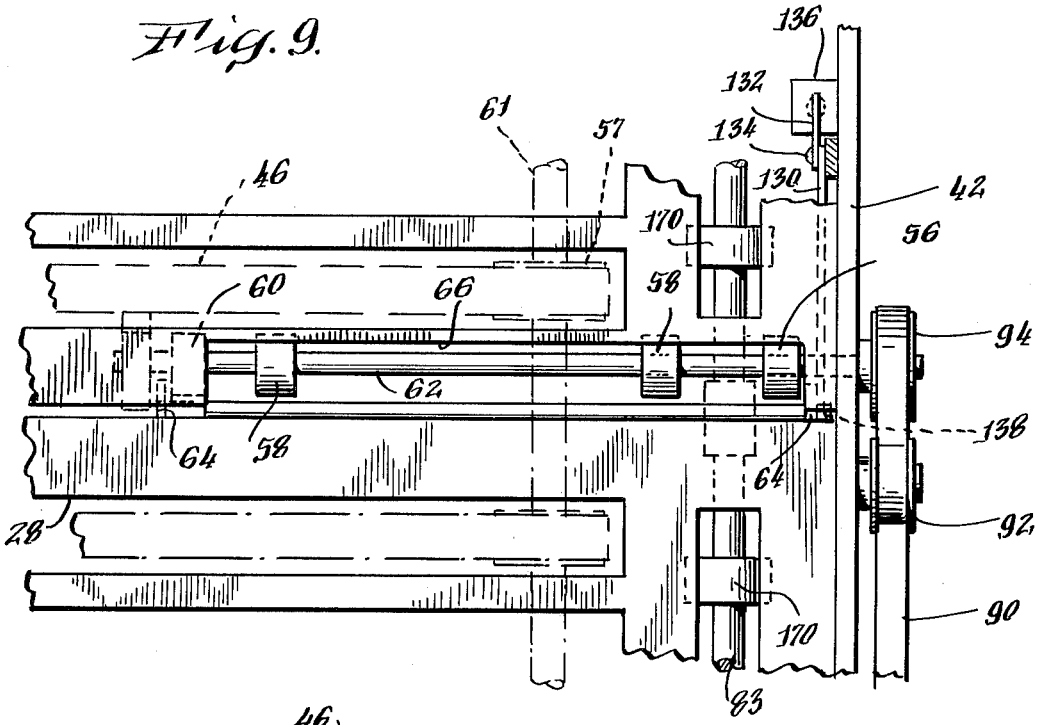
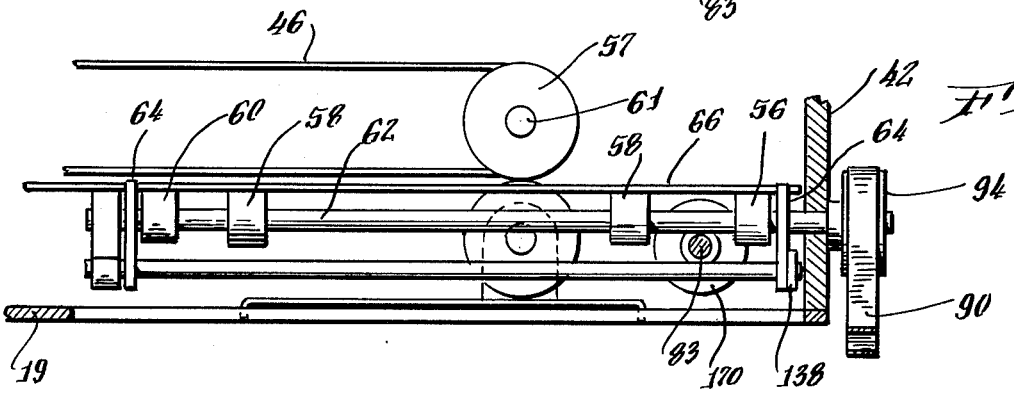
Fig. 8.
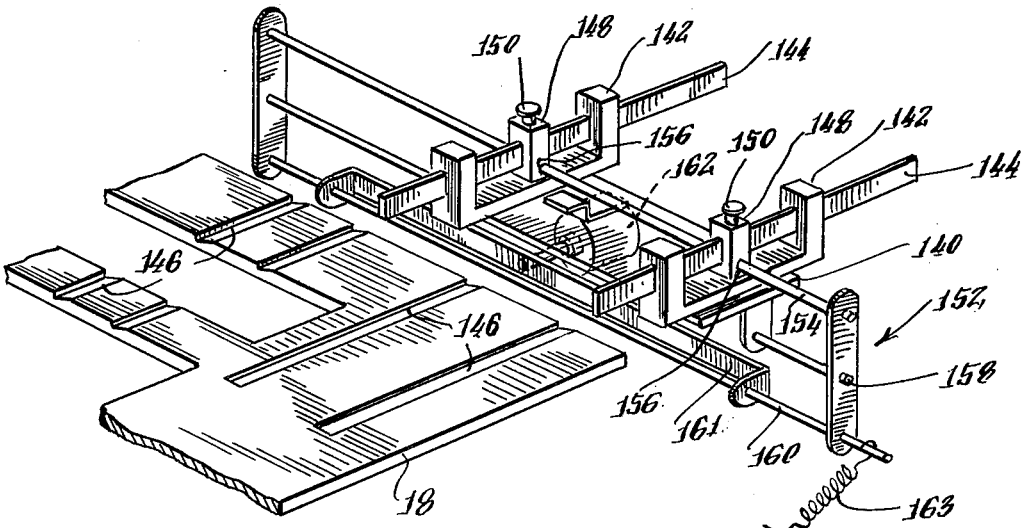
Fig. 10.

APPARATUS FOR COLLATING PAGES OF MULTI-UP PRINTED DOCUMENTS

BACKGROUND OF THE INVENTION

The present invention relates to an apparatus for collating pages of a document that are sequentially printed or otherwise arranged on a continuous sheet in multipage rows. For example, documents produced by rapid printing techniques in association with computer systems are often in the form of a fan-folded, continuous web. However, the fan-folded web may comprise a series of consecutive rows each having two or more pages arranged laterally thereacross. If two pages are printed in each lateral row, the fan-folded web is said to be in "two-up" form. Similarly, if three pages are arranged in each lateral row, the fan-folded web is said to be in "three-up" form. Higher multiples of pages arranged laterally across a paper web are, of course, possible. The apparatus of the invention may be adapted to collate documents printed on a fan-folded or other continuous web in two-up, three-up or greater multi-up form.

Documents printed on a fan-folded web in multi-up form often have random numbers of pages. For example, a fan-folded web in two-up form may have five pages that, accordingly, occupy two and one-half multipage rows, two pages being printed on each row. The next document printed on the fan-folded web may have eight pages that then occupy the remainder of the third row and the next three and one-half consecutive rows. The collating apparatus of the present invention may also be used to collate documents printed in this random fashion.

SUMMARY OF THE INVENTION

In its preferred embodiment, to be described below in detail, the collating apparatus of the present invention may be used to collate document pages arranged, for example, on a fan-folded web in multi-up fashion. However, the apparatus may be adapted to collate document pages arranged serially on a continuous web. The apparatus may also be adapted to collate documents, arranged in multi-up fashion on a fan-folded or other continuous web, having random numbers of pages.

In its preferred form, the apparatus is designed to collate pages of a document that are sequentially arranged on a continuous sheet in multipage rows. The apparatus comprises a plurality of decks, equal in number to the number of pages in each row on the continuous sheet. Each deck has a surface, for receiving one document page, that is positionable at a level above a deck surface immediately adjacent thereto. Accordingly, the decks define a step-like structure when positioned in this multilevel configuration.

A slitting mechanism separates adjacent pages in each multipage row on the continuous sheet and a cutting mechanism separates adjacent multipage rows on the sheet. A longitudinal delivery system then simultaneously delivers each of the separated pages in a single multipage row to a single deck. Subsequently, a lateral transfer system transfers the page delivered to each deck to the top of the page delivered to the adjacent lower deck. Therefore, all pages cut from a single multipage row ultimately arrive at the lowermost deck of the step-like structure in sequentially stacked fashion.

The multiple decks are also positionable with respective surfaces defining a single plane so that single or one-up document rows, that is, a document having a single page printed on the full width of the continuous sheet may be collated directly without lateral transfer by the lateral transfer system.

The collating apparatus of the invention also incorporates edge justifying fences and jogger mechanisms for neatly assembling the collated document to be immediately stapled or otherwise secured together. These fences and jogger mechanisms may be adjusted to accommodate document pages having varying dimensions.

In a desirable embodiment, wherein document pages are sequentially printed with machine readable code markings, the apparatus of the invention may be equipped with a code reader, which is well known in the art, that determines the number of pages in each sequentially printed document. Accordingly, the collating operation may be stopped when a single completed document is assembled and removed from the apparatus. After removal, the apparatus operation may be resumed in order to collate documents subsequently printed on the continuous web.

Accordingly, it is an object of the present invention to provide a collating apparatus which is capable of collating documents printed in multi-up fashion on a continuous web. Further, the apparatus may be adapted to collate single-up documents printed on a similar continuous web.

Other objects, aspects and advantages of the present invention will be pointed out in or will be understood from the following detailed description provided below in conjunction with the accompanying drawings.

BRIEF DESCRIPTION OF THE DRAWINGS

FIG. 8 is an enlarged vertical cross-sectional view taken through Plane 8—8 in FIG. 2 illustrating the lateral delivery system in detail.

FIG. 9 is a top plan view of that portion of the lateral delivery system illustrated in FIG. 8.

FIG. 10 is an enlarged perspective view of the lateral jogging mechanism used for jogging one-up document pages.

DETAILED DESCRIPTION OF THE PREFERRED EMBODIMENTS

Figure 2:
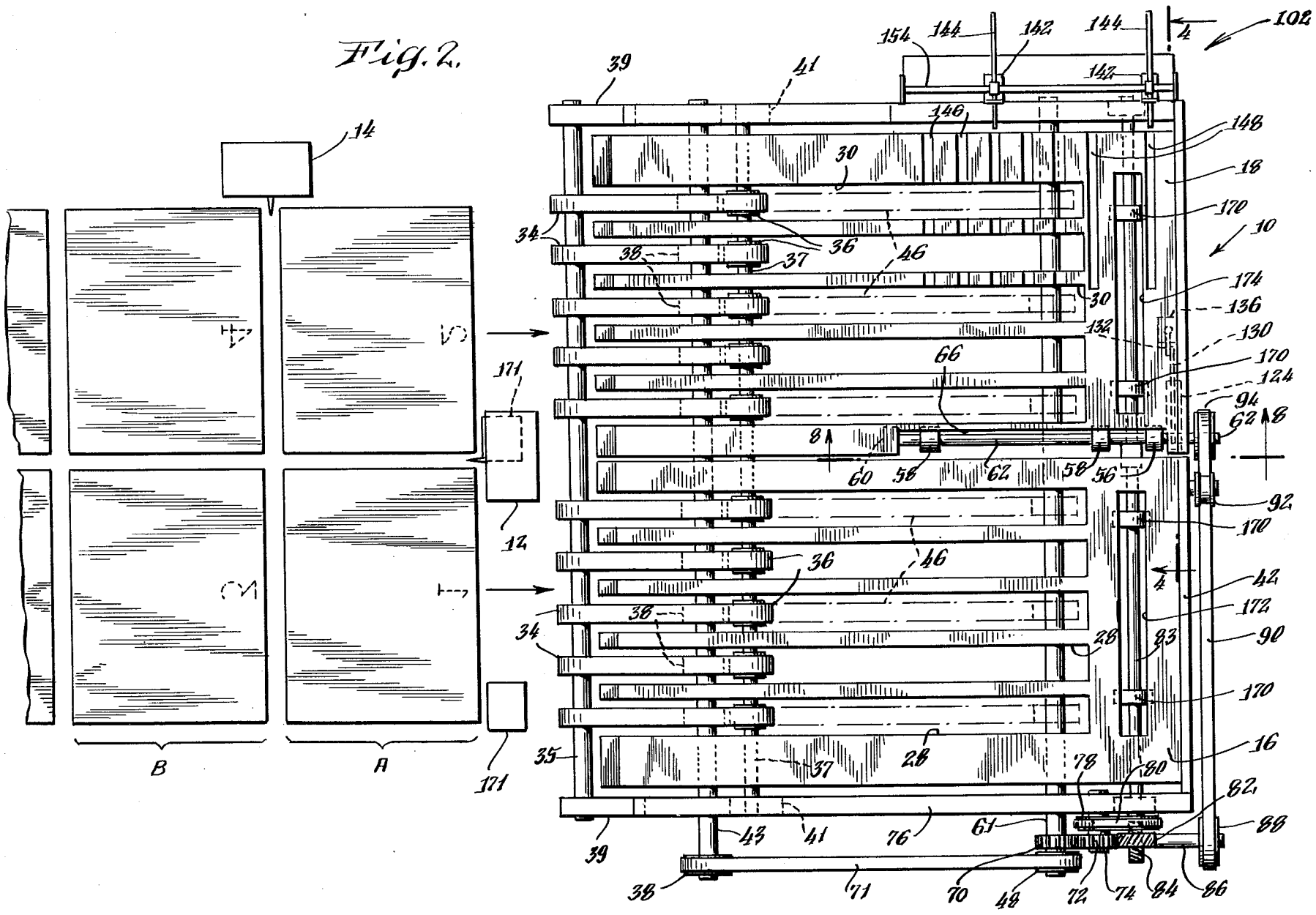
FIG. 2 is a top plan view of the apparatus showing its page receiving decks and portions of its longitudinal and lateral delivery systems.

The apparatus of the present invention is designed to collate documents, the pages of which are printed in multi-up fashion on a continuous fan-folded web. For convenience, the apparatus illustrated in the FIGURES and described below in detail is designed to collate two-up documents, that is, documents printed in two page rows which extend laterally across the continuous web. Thus, as can be seen in FIG. 2, a document may comprise consecutive pages numbered 1,2,3 and 4 which are arranged sequentially from right to left, bottom to top, as illustrated in two page rows, A,B, etc. Accordingly, to properly collate the illustrated four page document, assuming the printed portion of each page to be facing downwardly, as indicated by the reverse facing page numbers, Page 2 may be placed on top of Page 1 by being moved in a lateral direction. Page 3 then may be placed on the top of Page 2 by being moved in the longitudinal direction. Finally, Page 4 may be placed on top of Page 3 after having been moved in the longitudinal direction by then being moved in the lateral direction. If the document comprises only four pages, its pages may be stapled together and removed from the apparatus. Since the pages are assembled in proper sequential order by being fed to the apparatus in a face-down attitude, they read correctly when assembled into a final document. If more pages are included in the document, collating continues as described above. The apparatus of the present invention may be arranged to determine the number of pages in each document by being equipped with a code reading device to detect code information print on each page fed thereto. This feature will be described in greater detail below.

Figure 1:
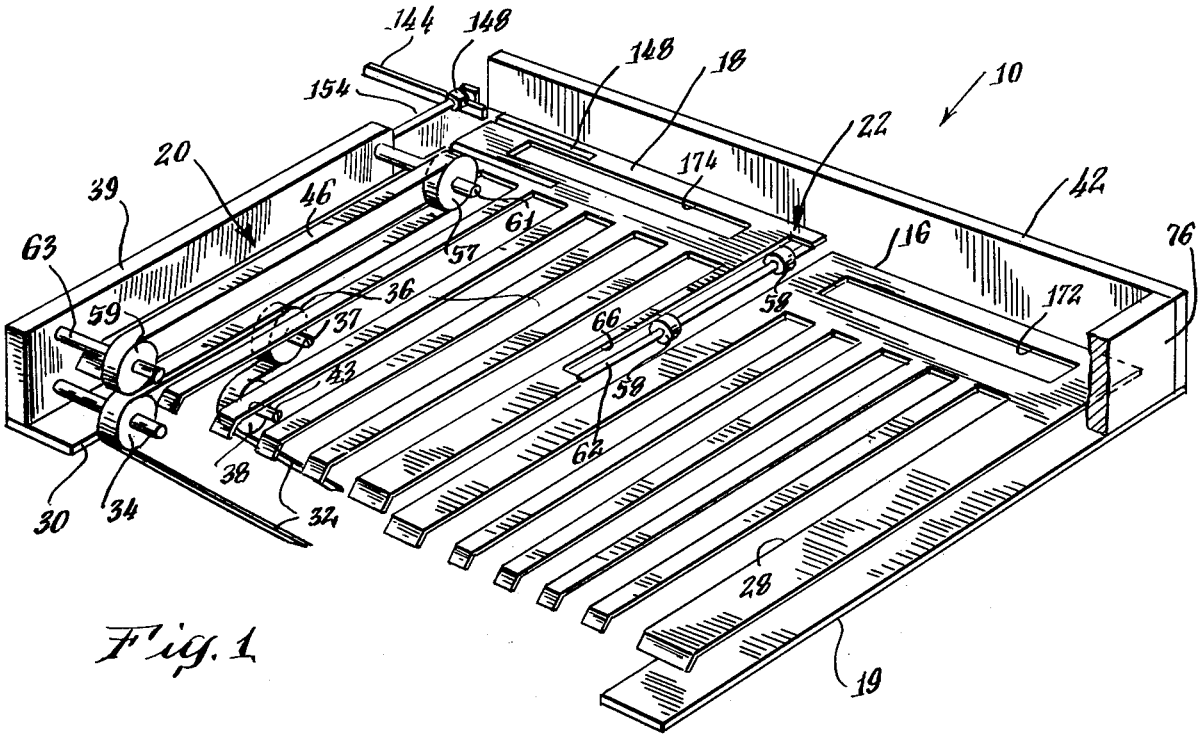
FIG. 1 is a perspective view of the present invention showing several of its components for collating pages of a multi-up document.

Referring now to FIGS. 1 and 2, the apparatus of the present invention, generally indicated at 10, comprises various mechanisms and systems for performing different operations on document pages fed to it. As shown in FIG. 2, the document Pages 1, 2, 3 and 4 are fed to the apparatus separated from one another. Typically, however, prior to reaching the apparatus, the documents are joined together in a continuous web, for example, of a fan-folded sheet. This is the format most frequently produced by common computer printing machinery. Accordingly, the apparatus of the invention comprises a slitting mechanism, illustrated diagrammatically at 12 for separating adjacent pages such as 1 and 2, and 3 and 4 in multipage rows A and B. Similarly, the apparatus comprises a cutter, diagrammatically illustrated at 14, for separating multipage rows A and B and subsequent rows from one another. Accordingly, when delivered to the collating mechanisms of the apparatus 10, the pages are in separate, independent form such as that illustratued, all face down.

As shown in FIG. 1, the apparatus 10 then comprises a plurality of decks for receiving the separated document pages. In the illustrated apparatus, which is adapted to collate two-up documents, the apparatus includes two decks 16 and 18 mounted with a base 19. Of course, if the apparatus is to be adapted for collating three-and-more-up documents, a corresponding number of decks need only be added.

The apparatus further comprises a longitudinal delivery system, a portion of which is generally indicated at 20, for delivering separated document pages to the decks 16 and 18, and a lateral delivery system, generally indicated at 22, for subsequently delivering the document placed on the lower deck 16. The apparatus also incorporates jogging and fence mechanisms, which will be described in greater detail below, for justifying parallel edges of the collated pages to form a neatly assembled document.

Figure 4:
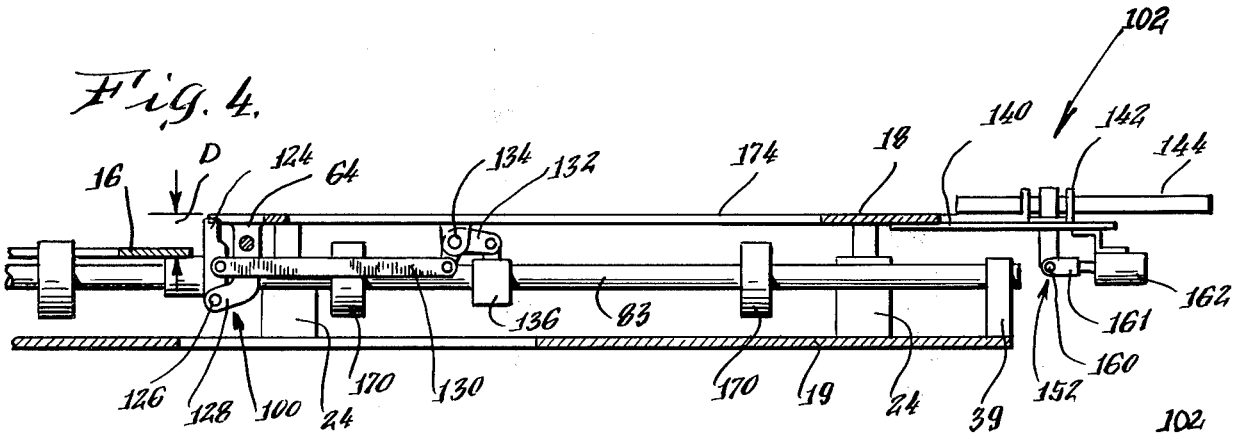
FIG. 4 is a front elevational view of the apparatus, taken from Plane 4—4 in FIG. 2, showing two lateral jogger mechanisms, one for jogging one-up document pages and one for jogging two-up document pages. The decks are shown in position for collating multi-up document pages.
Figure 5:
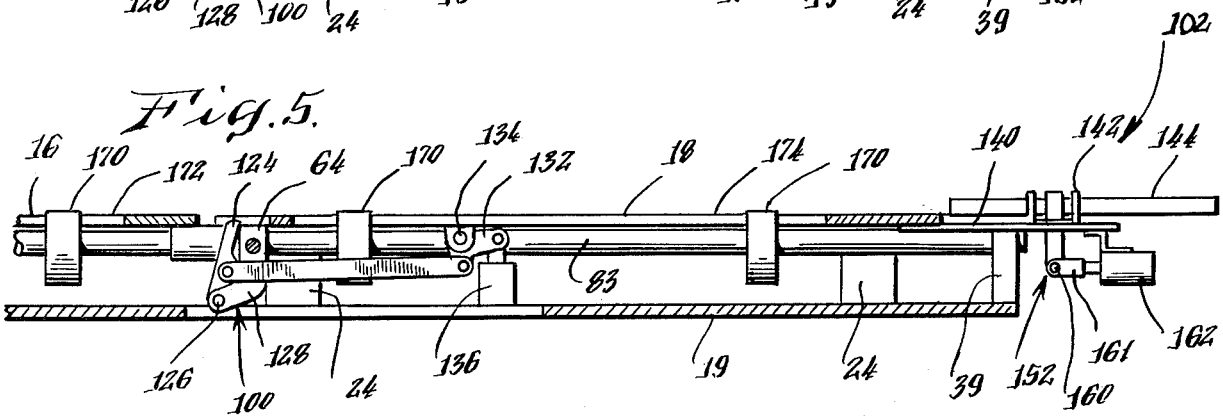
FIG. 5 is a front elevational view similar to that shown in FIG. 4 with the decks of the apparatus arranged to collate one-up document pages.

Referring now to FIGS. 2, 4 and 5, the decks 18 and 16 define upper surfaces that may receive documents delivered to them. While each deck is grooved and slotted to accommodate the other systems of the apparatus, these surfaces have sufficient integrity to support pages so delivered. Further, as can best be seen in FIGS. 4 and 5, the deck 18 defines an upper surface that may be positioned at a level above the surface of deck 16. When deck 18 is so positioned, the decks together define a step-like structure (FIG. 4).

The distance D separating the deck surfaces is greater than the thickness of the largest document likely to be collated by the apparatus for reasons that will be apparent from the description provided below. In order to collate two-up documents, the decks are positioned to define the step-like structure shown in FIG. 4. Accordingly, both pages in a multipaged row may be simultaneously longitudinally delivered thereto. Subsequently, the page delivered to the upper deck 18 is laterally transferred to the top of the page delivered to the lower deck 16. This may be easily accomplished due to the positioning of the respective decks. Then, the next multipage row is simultaneously delivered to the respective decks. Accordingly, in the example illustrated, Page 3 is then delivered to the top of Page 2 on deck 16 and Page 4 is delivered directly to deck 18. Again, Page 4 is subsequently delivered laterally to the top of Page 3. As noted, this operation continues until all pages of the document have been ultimately delivered to the lower deck 16 and the document has thus been completely assembled.

As shown in FIG. 5, the decks are also positionable so that their upper surfaces define a single plane. Several suitable jack mechanisms 24 are mounted between the apparatus base 19 and deck 18 to move the deck from its elevated and retracted positions shown in FIGS. 4 and 5 respectively. The deck 18 is placed in its retracted position when the apparatus is used to collate one-up document pages, that is, when each document page is defined by a single row printed on the continuous paper web. Accordingly, the apparatus of the present invention has the versatility to accommodate either one or multi-up document pages depending upon the print format of the web fed thereto.

When document pages printed in greater than two-up form are collated and further decks are added to the apparatus, these decks are mounted sequentially rightward from deck 18, as illustrated in FIGS. 4 and 5. Additional decks incorporate further jack mechanisms that are adapted to position each deck at a level above the immediately adjacent lower deck. In all other respects, each additional desired deck duplicates deck 18. Accordingly, description of this movable deck will suffice for any number of additional such decks.

Figure 7:
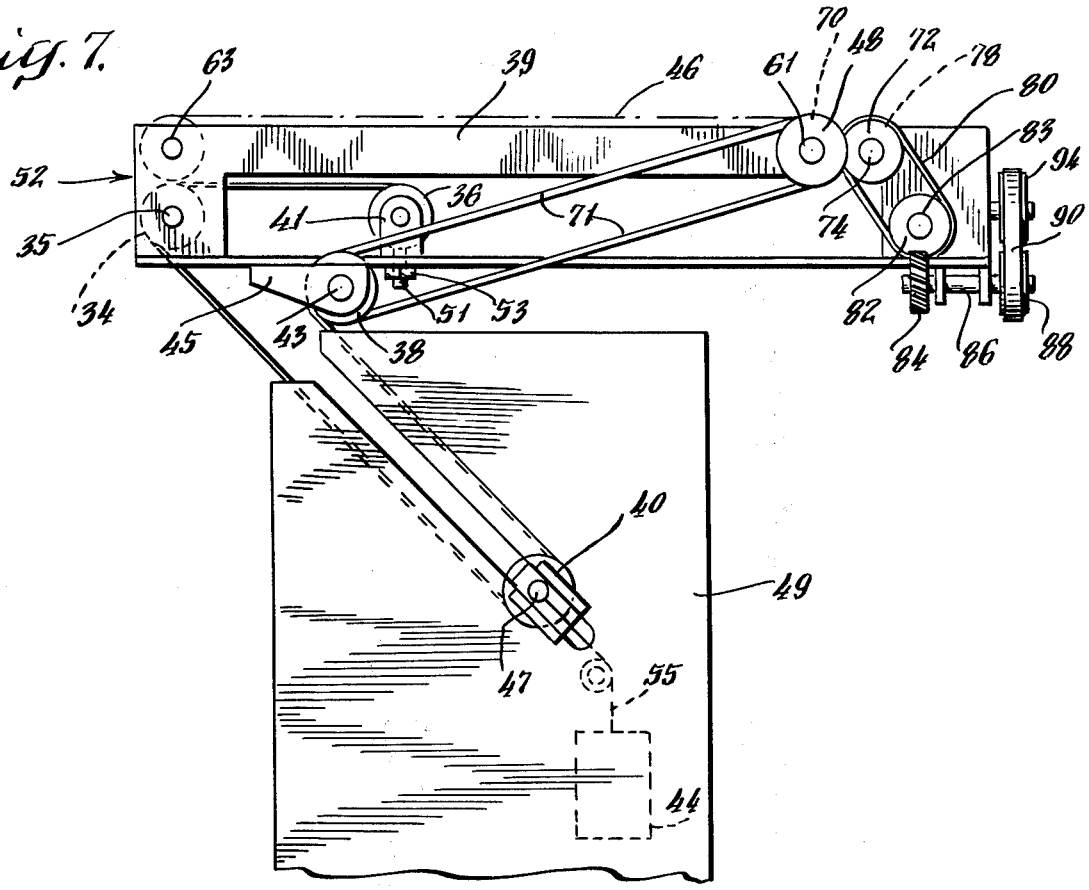
FIG. 7 is a side elevational view, similar to that shown in FIG. 6, illustrating the mechanical interconnection between the various components of the longitudinal delivery system as well as certain components of the lateral delivery system.
Figure 6:
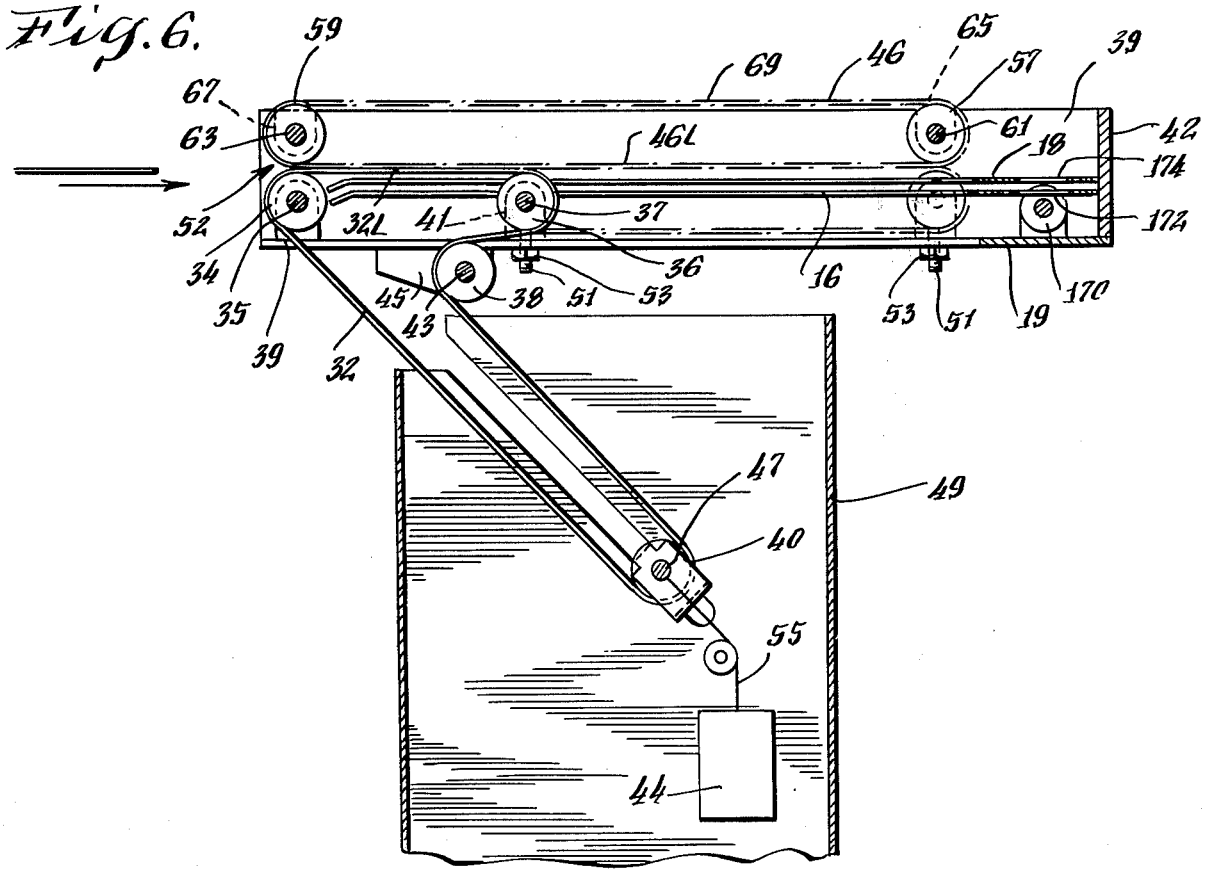
FIG. 6 is a side elevational view partly taken in vertical cross section showing the longitudinal delivery system in detail.

FIGS. 2, 6, and 7 illustrate in detail the system 20 of the invention for longitudinally delivering documents to the respective decks 16 and 18. This system comprises a belt system, the components of which are accommodated in longitudinally extending slots 28 and 30 formed in the decks 16 and 18 respectively. As can be seen in FIGS. 6 and 7, the belt system comprises a series of congruent lower belts 32 each of which passes over a first idler pulley 34, a second longitudinally adjustable idler pulley 36, a main drive pulley 38 and a take-up idler pulley 40. (Note that all lower belts and upper belts are the same. Therefore, description of one lower and one upper belt will suffice to describe all.)

The first and second idler pulleys 34 and 36 are mounted respectively on shafts 35 and 37 that are respectively journalled in upstanding spaced pairs of bosses 39 and 41, secured to the upper surface of apparatus base 19. Bosses 41 are longitudinally adjustable in a manner to be described below. Similarly, the drive pulley 38 is mounted on a drive shaft 43 that is journalled between a pair of bosses 45 which depend from the underside of base 19. The take-up idler pulley 40 is mounted on a diagonally slidable shaft 47 mounted in a protective housing 49 beneath the base 19. The shaft is placed in tension to compensate for adjustment of second idler pulleys 36 in a manner described below.

The drive pulley 38 is powered by a motor (not shown) to rotate in a counter-clockwise direction in order to move the longitudinally extending section 32L in a left-to-right direction. In order to accommodate document pages having various longitudinal dimensions, the adjustable idler pulley 36 is movable toward and away from the longitudinal extreme of the decks 16 and 18, defined by a laterally extending fence 42, by virtue of the movable nature of bosses 41. In particular, the bosses may be equipped with lock bolts 51 that depend through longitudinally extending slots in base 19. Lock nuts 53 are engaged on the bolts to secure the bosses in the desired longitudinal location. The take-up pulley 40 is mounted under tension created by a weight 44 linked to shaft 47 by a cable 55. Thus the belt 32 is maintained in tension during operation.

As can be seen in FIGS. 5, 6 and 7, each lower belt 32 of the longitudinal delivery system cooperates with an upper belt 46 that is driven so that its lower longitudinally extending surface 46L moves toward the fence 42. The upper belt passes over two idler pulleys 57 and 59 which are mounted respectively on shafts 61 and 63. The shafts are journalled respectively in pairs of bosses 65 and 67 that depend from an upper apparatus closure plate 69. Movement of the upper belt is accomplished by interconnection of a drive pulley 38 with a driven pulley 48 mounted on shaft 61 through a drive belt 71 (FIGS. 2 and 7).

Accordingly, as can be seen in the FIGURES, the congruent upper and lower belts define a nip 52 into which document pages may be fed. Once so fed, the documents are carried by the cooperating belts to ultimately be delivered to the respective decks. Further, as shown in FIG. 6, the belts are mounted so that their nip is positioned a significant distance above the upper surface of the uppermost deck 18. Accordingly, all longitudinal belts may be driven at the same time using the same power source to deliver documents to the respective decks irrespective of their positions.

The pulleys 36 are adjusted by longitudinal movement of the shaft 37 on which they are mounted to position the exit from nip 52, a distance from the fence 42 approximately equal to the longitudinal dimension of the pages being collated. This adjustment insures the leading page edge being carried to the fence for proper document assembly.

The apparatus of the invention also incorporates a lateral transfer system for sequentially transferring pages delivered to the upper deck 18 to the top of pages delivered to the lower deck 16. The lateral transfer system includes at least three delivery rollers 56, 58 and 60 shown in FIGS. 2, 8 and 9. Each of the rollers is mounted on a shaft 62 that is journalled in supports 64 depending from the underside of deck 18. Further, the rollers are mounted to project through a longitudinally extending slot 66 in the deck 18.

Figure 3:
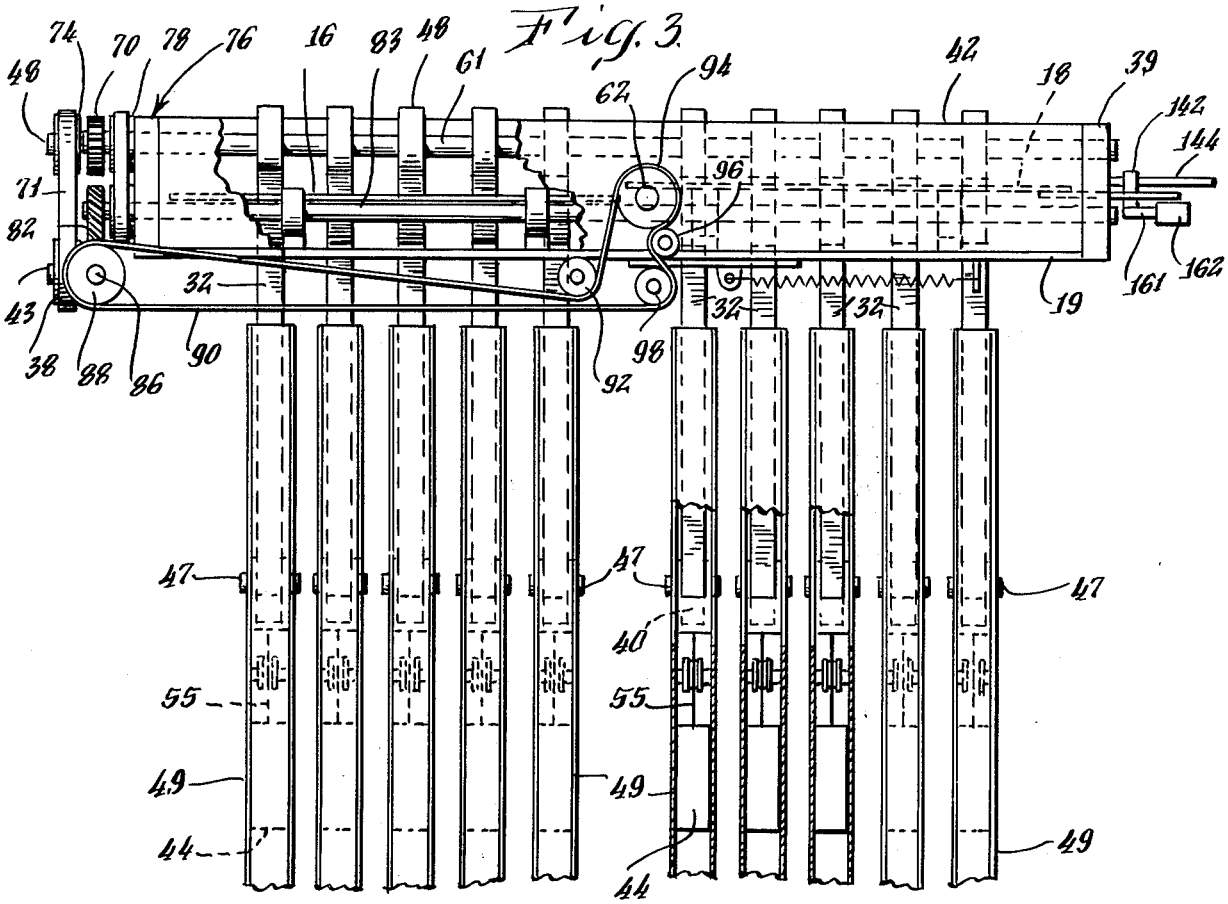
FIG. 3 is a front elevational view of the apparatus partly broken away to reveal internal detail, illustrating the respective delivery systems and an ejector system for removing completed documents therefrom.

The shaft 62 is driven from the drive shaft 43 through a drive train shown in FIGS. 2, 3 and 7. Specifically, the shaft 43 drives the upper driven shaft 61 to which is pinned a drive pinion 70 that powers a driven pinion 72 mounted on a shaft 74 cantilevered from a side fence 76 of the apparatus. The side fence may be longitudinally adjustable to accommodate sheets of varying widths. A driven pulley 78 is in turn powered from pinion 72 and rotates a belt 80 that powers a helical hear 82 mounted to rotate with a shaft 83 that extends below deck 16 across the width of the apparatus. The gear 82 in turn drives a helical gear 84 which rotates a shaft 86 to drive a pulley 88. Pulley 88 in turn drives a belt 90 that passes over a first idler 92, a driven pulley 94 which is connected to the shaft 62, a third idler 96 and a take-up idler 98.

Accordingly, it can be seen that both the lateral and longitudinal delivery systems are driven by the same power source. Further, it can be seen that when pages are delivered to the upper deck 18 their edge adjacent the lower deck 16 is delivered to the surface of the rotating lateral transfer rollers 56, 58 and 60. Accordingly, they are immediately transferred to the top of the sheet page delivered to the lower deck 16.

If desired, tensioning rollers may be mounted above the lateral transfer rollers to insure firm contact of the sheet edge therewith and thus positive delivery to the lower deck.

The apparatus of the invention also incorporates jogging mechanisms for justifying or registering the edges of collated document pages so that assembled documents are neatly completed. In particular, the apparatus incorporates longitudinal joggers generally indicated at 98 in FIG. 11 for jogging the trailing edges of documents against the fence 42 to justify the laterally extending edges. Further, the apparatus incorporates two lateral joggers shown in FIGS. 4 and 5. First of these joggers, generally indicated at 100, is adapted to jog the longitudinally extending edges of two-up document pages. The other lateral jogging mechanism, generally indicated at 102, is arranged to jog the longitudinally extending edges of one-up document pages and is mounted on the outer-most edge of the upper deck 18.

Figure 11:
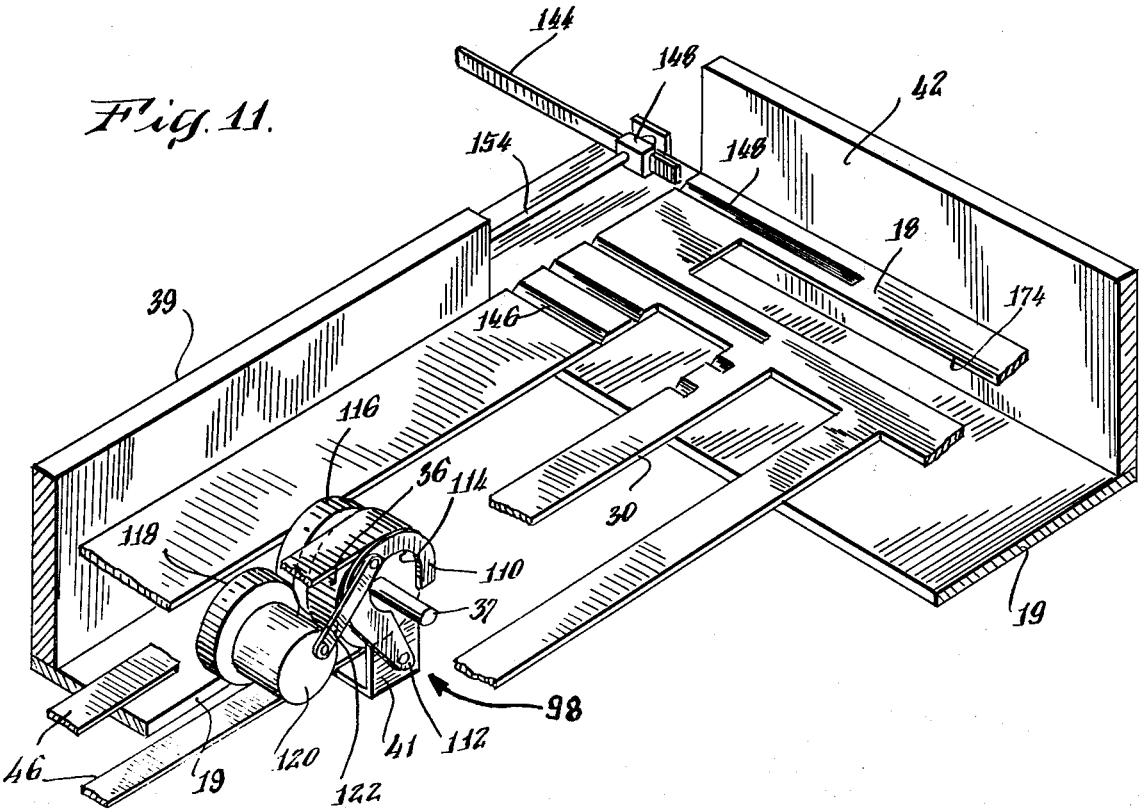
FIG. 11 is an enlarged perspective view of a longitudinal jogger mechanism which operates in conjunction with the longitudinal delivery system.

The longitudinal jogger mechanism is illustrated in detail in FIG. 11, and comprises an inverted J-shaped jogger finger 110 mounted to pivot about a fulcrum pin 112 attached to the upstanding support 41 for the adjustable idler pulley shaft 37. The jogger finger is formed with an open throat 114 that accommodates the shaft 37 to permit free pivoted movement. A spur gear 116 is mounted with the shaft 37 to rotate therewith when the idler pulley 36 is rotated. The spur gear meshes with a driven gear 118, which is mounted on shaft (not shown) that is in turn journalled in a portion of the upstanding support 41. A drum or flywheel 120 is mounted to rotate with the driven gear 118 and is connected to the jogger finger by a crank 122. Accordingly, as can be appreciated from FIG. 11, when the drum 120 rotates indirectly through the pulley 36, the jogger finger is oscillated in pivoted fashion about pin 112 by crank 122. When the idler pulley is properly adjusted for the longitudinal dimension of the page being collated, the jogger finger is appropriately positioned to tap the trailing edge thereof against the leading fence 42.

The first lateral jogger mechanism 100 for laterally jogging collated documents, shown in FIGS. 4 and 5, comprises a number of jogger fingers 124 that are mounted to pivot about a fulcrum pin 126 mounted in a depending dog-leg support 128 beneath the upper deck 18. The dog-leg sections are mere extensions of the depending supports 64. The jogger fingers 124 are connected through a link 130 to a bell crank 132 pivoted from depending support 134. The crank 132 is powered by a solenoid 136 to oscillate the jogger fingers between an upright position shown in FIG. 4 into a retracted position shown in FIG. 5. The oscillation is accomplished in rapid sequence to jog the lateral edges of the assembled document pages against the side fence 76.

The second lateral jogger mechanism 102, which is used for jogging one-up document pages, is illustrated in detail in FIGS. 4, 5 and 10, and comprises a table extension 140 from the outermost lateral edge of the upper deck 18. Mounted on the extension are two U-shaped brackets 142 which may be adjusted longitudinally along the table 140. The U-shaped brackets support jogger bars 144 which are registered with slightly undercut slots 146 formed in the top of the deck 18. These jogger bars may be moved freely axially in the U-shaped brackets. Each is equipped with an adjustment bracket 148 having a lock screw 150 thereon. Accordingly, the jogger bar can be fixed in any position in relation to the adjustment bracket 148.

A pivoting gate generally indicated at 152, comprises an upper bar 154 which registers with open slots 156 formed in the bottom of each adjustment bracket 148. The gate is mounted to pivot on a central shaft 158 and is actuated through a lower shaft 160 to a bracket 161 coupled to the armature of a solenoid 162. Accordingly, as can be seen in FIG. 10, when the solenoid is energized to retract its armature, the gate is pivoted in a counter-clockwise direction, moving the jogger bars 144 leftwardly. When the solenoid is deenergized, springs 163 (FIG. 10) force the gate to pivot in a clockwise direction, retracting the jogger bars rightwardly. Accordingly, by rapid sequential actuation of the solenoid, the jogger bars may be made to oscillate in slots 146 to jog a lateral edge of one-up documents against the side fence 76. The adjustment provided by the adjustment brackets and lock screws 148 and 150 permits the lateral jogger to be set for one-up document pages having varying widths.

As can be seen in FIGS. 2, 4 and 5, the apparatus also incorporates an ejection system comprising two pairs of ejection rollers 170 mounted beneath each deck. The ejection rollers are mounted on the constantly rotating shaft 83 to project slightly through a slot 172 formed in lower deck 16. Similarly, the second pair of rollers 170 project through a second slot 174 in the upper deck 18 when moved to its retracted position shown in FIG. 5. Accordingly, when a collated document has been assembled, it may be ejected from the apparatus by raising the lateral fence 42. The constant rotation of ejection rollers 170 then immediately forces the assembled document out of the apparatus where its pages may be stapled or otherwise secured together for distribution.

As noted above, the apparatus of the invention may also be equipped with two code reading stations, diagrammatically indicated at 171, for determining when a document having a random number of pages has been completely assembled. These code reading stations are adapted to identify the last page in the document and to stop operation of the apparatus until the assembled document has been ejected from the machine in the manner described above.

It can be appreciated from the above description that the apparatus of the present invention is capable of collating one, two or multi-up documents printed on a continuous fan-folded sheet. Its components are adapted to be driven by a single power unit continuously. Therefore, starting and stopping of the components of the apparatus is minimized. Accordingly, simple yet effective operation may be achieved.

Although a specific embodiment of the present invention has been described above in detail, it is to be understood that this is for purposes of illustration. Modification may be made to the described collating apparatus in order to adapt it to particular applications.

What is claimed is:

1. An apparatus for collating pages of a document initially arranged sequentially on a continuous sheet in multipage rows, said apparatus comprising:

A. a plurality of decks, at least equal in number to the number of pages in each row on the sheet, each having a surface for receiving one document page, said decks being movable from relatively elevated positions in which each deck surface is positioned at a level above one deck surface adjacent thereto thereby defining a step-like structure and coplanar positions in which said deck surfaces are in coplanar relation;

B. means for moving said decks between the elevated and the coplanar positions;

C. longitudinal delivery means for simultaneously delivering each of the pages in a single multipage row to a single deck; and D. lateral transfer means for transferring the page delivered to each deck to the top of the page delivered to the adjacent lower deck.

2. The apparatus for collating pages of a document as claimed in claim 1, further comprising:

slitting means for separating adjacent pages in a multipage row on the sheet.

3. The apparatus for collating pages of a document as claimed in claim 1, further comprising:

cutting means for separating multipage rows on the sheet.

4. The apparatus for collating pages of a document as claimed in claim 1, further comprising:

lateral fence means mounted laterally with each of said decks against which a leading lateral page edge of each page may be registered.

5. The apparatus for collating pages of a document as claimed in claim 4, further comprising:

longitudinal jogger means for jogging a trailing lateral edge of each page to register a leading lateral edge thereof, opposite said trailing lateral edge, against said lateral fence means.

6. The apparatus for collating pages of a document as claimed in claim 1, further comprising:

longitudinal fence means mounted longitudinally with the lowest deck against which leading longitudinal edges of pages transferred to said lowest deck may be registered.

7. The apparatus for collating pages of a document as claimed in claim 6, further comprising:

lateral jogger means for jogging a longitudinal edge of each page delivered to said lowest deck to register an opposing longitudinal edge against said longitudinal fence means.

8. The apparatus for collating pages of a document as claimed in claim 1, further comprising:

means for adjusting said longitudinal delivery means to receive separated pages of varying lengths and deliver them to said decks.

9. An apparatus for collating pages of a document sequentially arranged on a continuous sheet in multipage rows, said apparatus comprising:

A. a plurality of decks, at least equal in number to the number of pages in each row on the sheet, each having a surface for receiving one page;

B. means for elevating each deck to a position with its surface above that of one deck immediately adjacent thereto to define a step-like structure and for lowering said decks to a position with the surfaces of all in substantially coplanar relation;

C. slitting means for separating adjacent pages in a multipage row on the sheet;

D. cutting means for separating adjacent multipage rows on the sheet;

E. cooperating delivery belt means comprising upper and lower synchronously operable belts having mutually parallel faces arranged to grip a page therebetween and deliver it to one deck; and F. roller means comprising a drive roller mounted to project above the surface of each deck, engage a page delivered thereto, and transfer it to the top of a page delivered to the adjacent lower deck.

10. The apparatus for collating pages of a document as claimed in claim 9, wherein said roller means is mounted in a slot formed in its associated deck along an edge thereof adjacent the next lower deck, the axis of said roller means extending substantially parallel to the direction of page feed from said delivery belt means.

11. The apparatus for collating pages of a document as claimed in claim 9 further comprising:

lateral fence means mounted laterally with each of said decks against which a leading lateral edge of each page may be registered.

12. The apparatus for collating pages of a document as claimed in claim 11 further comprising:

longitudinal jogger means for jogging a trailing lateral edge of each page to register a leading lateral edge thereof, opposite said trailing lateral edge, against said lateral fence means.

13. The apparatus for collating pages of a document as claimed in claim 12 wherein said lower delivery belt passes over an idler pulley and wherein said longitudinal jogger means comprises:

A. at least one jogger arm mounted for pivoted reciprocal movement about a pivot point fixed with respect to the axis of said idler pulley, B. a shaft mounted with its axis substantially parallel to the axis of said idler pulley, C. means for interconnecting said idler pulley and said shaft for rotation therewith, D. a flywheel mounted for rotation with said shaft; and E. a connecting rod linking said flywheel and said jogger arm whereby rotation of said flywheel causes pivoted reciprocal movement of said jogger arm.

14. The apparatus for collating pages of a document as claimed in claim 9 further comprising:

a longitudinal fence mounted longitudinally with the lowest of said decks against which leading longitudinal page edges of pages transferred to said lowest deck may be registered.

15. The apparatus or collating pages of a document as claimed in claim 14 further comprising:

lateral jogger means for jogging a longitudinal edge of each page delivered to said lowest deck to reister an opposing longitudinal page edge against said longitudinal fence.

16. The apparatus for collating pages of a document as claimed in claim 15 wherein said lateral jogger means is mounted at the edge of said lowest deck opposite said longitudinal fence to register edges of pages delivered to said lowest deck against said longitudinal fence.

17. The apparatus for collating pages of a document as claimed in claim 16 wherein said lateral jogger means is mounted beneath the deck adjacent said lowest deck and comprises:

A. at least one jogger arm mounted for reciprocal pivoted movement; and

B. a solenoid for rapidly actuating said jogger arm through its reciprocal movement.

18. The apparatus for collating pages of a document as claimed in claim 15 wherein said lateral jogger means is mounted at the outermost edge of said deck, which is positionable at the uppermost level, opposite said longitudinal fence to register edges of pages which comprise a full row against said longitudinal fence.

19. The apparatus for collating pages of a document as claimed in claim 18 wherein said lateral jogger means comprises:

A. at least one reciprocally mounted elongated jogger bar which extends in the lateral direction, having an end formed to jog an edge of a full row page; and B. means for reciprocating said jogger bar in the direction of its major dimension.

20. The apparatus for collating pages of a document as claimed in claim 19 wherein said jogger bar is adjustable in the direction of its major dimension to accommodate pages of varying widths.

21. The apparatus for collating pages of a document as claimed in claim 19 wherein said deck with which said jogger bar is mounted is formed with a groove in its page receiving surface for accommodating said bar, said bar thus lying, in part, below said surface and, in part, above said surface.

22. The apparatus for collating pages of a document as claimed in claim 19 wherein said reciprocating means comprises:

A. a gate mounted for reciprocal pivoted movement;

B. a link for coupling said gate to said bar without inhibiting the reciprocal movement thereof;

C. means for pivoting said gate to, in turn, reciprocate said bar.

23. The apparatus for collating pages of a document as claimed in claim 22 wherein said pivoting means is a solenoid.

24. The apparatus for collating pages of a document as claimed in claim 9, wherein each deck is formed with elongated longitudinal slots, at least one of said upper and said lower belts being at least partially accommodated in each of said slots, the plane defined by said parallel belt faces being slightly elevated above the surface of said deck.

25. An apparatus for collating pages of a document sequentially arranged on a continuous sheet in multi-page rows, said apparatus comprising:

A. a plurality of decks, equal in number to the number of pages in each row on the sheet, each having a surface for receiving one document page, said decks being movable from relatively elevated positions in which each deck surface is positioned at a level above one deck surface adjacent thereto thereby defining a step-like structure to coplanar positions in which said deck surfaces are in coplanar relation;

B. means for moving said decks between the elevated and the coplanar positions;

C. slitting means for separating adjacent pages in a multi-page row on the sheet;

D. cutting means for separating adjacent multi-page rows on the sheet;

E. longitudinal delivery means for simultaneously delivering each of the separated pages in a single multi-page row to a single deck; and F. lateral transfer means for transferring the page delivered to each deck to the top of the page delivered to the adjacent lower deck.

* * * * *